United States Patent [19]

Jehle et al.

[11] 4,296,700

[45] Oct. 27, 1981

[54] DEVICE FOR THE AUTOMATIC GUIDING OF A WORKPIECE ON A SEWING MACHINE

[75] Inventors: Fritz Jehle, Enkenbach-Alsenborn; Erich Willenbacher, Kaiserslautern, both of Fed. Rep. of Germany

[73] Assignee: Pfaff Industriemaschinen GmbH, Fed. Rep. of Germany

[21] Appl. No.: 144,039

[22] Filed: Apr. 28, 1980

[30] Foreign Application Priority Data

May 4, 1979 [DE] Fed. Rep. of Germany ..... 2917950

[51] Int. Cl.[3] ..... D05B 35/10

[52] U.S. Cl. ..... 112/153; 112/308; 112/315

[58] Field of Search ..... 112/308, 309, 153, 315

[56] References Cited

U.S. PATENT DOCUMENTS

| | | | |
|---|---|---|---|
| 3,080,836 | 3/1963 | Clemens et al. | 112/308 X |
| 3,954,071 | 5/1976 | Mall et al. | 112/153 X |
| 4,131,076 | 12/1978 | Johnson | 112/315 |
| 4,135,460 | 1/1979 | Biotteau | 112/308 X |

FOREIGN PATENT DOCUMENTS

| | | | |
|---|---|---|---|
| 2278819 | 2/1976 | France | 112/308 |

*Primary Examiner*—H. Hampton Hunter
*Attorney, Agent, or Firm*—McGlew and Tuttle

[57] ABSTRACT

A device for the automatic guiding of a workpiece on a sewing machine to produce a curved edge parallel seam operates in conjunction with a sewing machine having a reciprocating needle and a presser foot engageable with the workpiece and a feed member engageable with the workpiece to move it relative to the needle. The sewing machine also includes a guide roll disposed in spaced relationship to the needle for guiding the edge of the workpiece and a scanner for scanning the workpiece edge for sensing its position. In accordance with the position sensed, a plunger is mounted above the workpiece and is movable into the engagement with the workpiece to hold the workpiece at a selected point so as to turn the workpiece during the feeding movement of the workpiece by this feed member. A fluid pressure operated drive is connected to the plunger so as to engage it with the workpiece and the operation thereof is dependent upon a second fluid pressure drive which varies the operation of a stitch length setting mechanism which includes a stitch length setting bar which is movable to change the length of the feeding movement of the feed member.

4 Claims, 3 Drawing Figures

DEVICE FOR THE AUTOMATIC GUIDING OF A WORKPIECE ON A SEWING MACHINE

BACKGROUND OF THE INVENTION

Field of the Invention

This invention relates, in general, to sewing machines and, in particular, to a new and useful device for automatically guiding the workpiece on a sewing machine particularly to produce a curved edge parallel seam.

Such a device is known through German Patent Application DE-OS No. 25 22 422. The drive device of the plunger, a pneumatic cylinder, is actuated by the edge scanning device at the convex work edge areas deviating from a straight line via a solenoid valve, so that the plunger is lowered onto the work for the production of a curved edge-parallel seam laterally spaced from the cloth feed and presses it against the work support. The cloth feed, meanwhile, continues to operate, so that the work is rotated about the plunger as an axis of rotation. The pressing force must be so great that also narrow radii can be controlled exactly to obtain an edge-parallel seam. Due to the braking, the cloth feed set to a certain stitch length cannot fully transmit its feed action to the work, resulting in much shorter stitches than on the seam sections to be sewn without the plunger; this not only impairs the good appearance of the work but also is not acceptable because of the fragment piercing and hence weakening of the material and because of the conspicuous stitch accumulation in the curved areas.

SUMMARY OF THE INVENTION

This invention makes it possible to sew edge-parallel seams on workpieces with an irregular curved pattern on the entire sewing line and with equal stitch lengths.

In accordance with the invention, a device for the automatic guiding of a workpiece on a sewing machine to produce a curved edge parallel seam operates in a sewing machine which has a reciprocating needle and a presser foot which engage the workpiece and a feed member which engage the workpiece to move it relative to the needle, and further including a guide rule disposed in spaced relationship to the needle for guiding the edge of the workpiece. A scanner is employed on this machine for scanning the workpiece edge for sensing the position thereof and, in accordance with the scanning which is done, a plunger is moved to engage the workpiece and pivot it so that it will cause the turning of the workpiece during the further feeding by the feed member. The length of the feed during the engagement of it by the plunger is controlled by a stitch length setting mechanism which is operated by a fluid pressure operated drive which is connected to a similar fluid pressure operated drive for the plunger so that the two of them operate as a function of each other.

The braking of the work caused by the setting down of the plunger on the work and the reduced feed occurring as a result thereof are compensated by the fact that during the time in which the plunger is lowered onto the work, that is, during the sewing of the curved edge areas of the work, a greater feed movement is imparted to the work than on the straight edge lengths.

Accordingly, it is an object of the invention to provide an improved mechanism for varying the feed of a workpiece and for engaging the workpiece so that it turns as it is being fed which operate as a function of each other so as to permit the formation of curved edge parallel seams.

A further object of the invention is to provide an apparatus for controlling the sewing of a curved edge seam which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
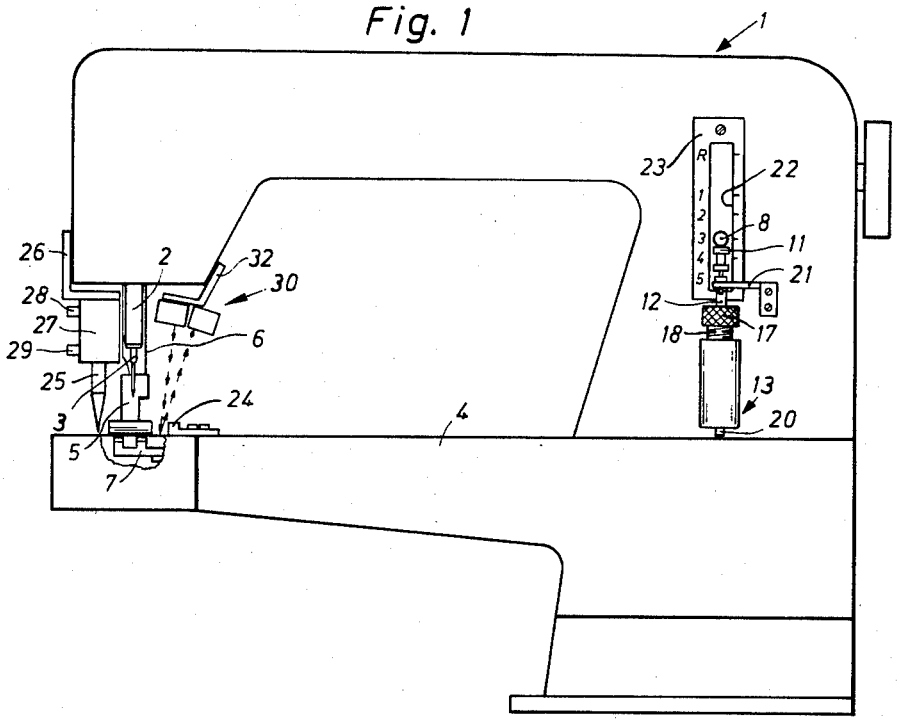
FIG. 1 is a side elevational view, partly broken away, of a sewing machine constructed in accordance with the invention.

Referring to the drawings, in particular, the invention embodied therein comprises a device for automatically guiding a workpiece (not shown) on a sewing machine, generally designated 1, which has a reciprocating needle 3 and an associated presser foot 5 engageable with the workpiece in addition to a feed member 7 which moves through a substantially rectangular feed path in order to move the workpiece relative to the needle. The sewing is carried out by moving the workpiece alongside of a guide rule 24 which is disposed in spaced relationship to the needle. In addition, a scanning mechanism 30 scans the edge of the workpiece and controls the movement of a plunger 25 which is engageable with the workpiece and holds it while further feeding movement of the feed member 7 will cause a pivoting of the workpiece. The plunger movement is controlled by a fluid-pressure operated mechanism generally designated 27 and the stitch length is controlled by a fluid pressure operated mechanism 13 which controls the position of a stitch length setting lever 8.

Figure 2:
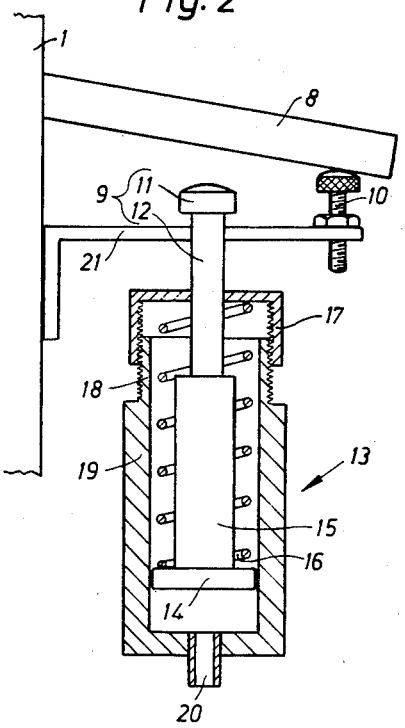
FIG. 2 is an enlarged transverse sectional view showing the fluid pressure drive for the setting of the stitch length.
Figure 3:
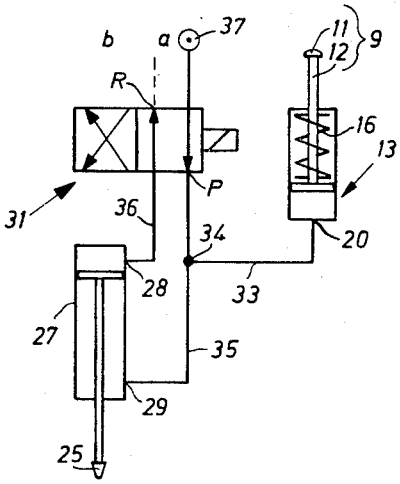
FIG. 3 is a schematic view of the fluid pressure drive for the plunger and for the stitch length setting indicating their functional arrangement.

The sewing machine 1 may be equipped with a known binding apparatus for binding the edge of a workpiece of irregular contour by means of a band strip. For greater clarity the binding apparatus is now shown in the drawing. In the head of the sewing machine 1, a needle bar 2 is mounted for up and down movement, and it carries at its lower end a thread-guiding needle 3, which cooperates for stitch formation with a looper (not shown) disposed in an arm 4 of the sewing machine. By a presser foot 5 fastened to the presser bar 6 under spring action, the work is pressed against the cloth feed dog 7 which executes a rectangular movement or against the work support surface of arm 4. The setting of the values of the feed movements imparted to the cloth feed dog 7 is effected by means of the stitch length setting lever 8 under spring action of the stitch length setting device, which is known and therefore not shown in greater detail. The stitch length setting lever 8 has associated with it two stitch length limiting stops 9 and 10. The first limiting stop 9 is formed by a piston rod 12, fitted with a damping piece 11, of a single-action pneumatic piston and cylinder set 13. The piston rod 12 comprises at its end adjacent to the piston 14 a shank portion 15 of greater diameter and the piston 14 is pressed, when the cylinder is vented, into an inoperative position under the action of a spring 16, FIG. 2. The stroke of piston rod 12 is adjustable by a cap nut 17 provided on a threaded shoulder 18 of the cylinder housing 19. The cylinder housing 19 comprises a compressed air connection 20.

The second stitch length limiting stop 10 is formed by a setting screw which is screwed into a bracket 21 secured to the machine housing. When the pneumatic cylinder 13 is vented, the stitch length setting lever 8, which is brought out through a slot 22 in the machine housing, applies against stop 10 under spring action. The set feed values can be read on a scale 23 cooperating with the stitch length setting lever 8.

For the guidance of the work edge there is fastened on the arm 4 of the sewing machine laterally spaced from and, seen in feed direction, before the needle 3 a guide rule 24, which may have a roller against which the work edge applies. On the side of the needle 3 opposite the guide rule 24, a plunger 25 is arranged which is fastened to the piston rod of a pneumatic cylinder 27 disposed on a bracket 26 fast on the housing. The cylinder 27 has compressed air connections 28 and 29. The pneumatic cylinders 13 and 27 are actuated by a photoelectric work edge scanning device 30 via a 4/2-way solenoid valve 31. To reflect the light beam emitted by a light source of the edge scanning device 30, the work support surface of arm 4 is polished. The work edge scanning device 30 is arranged on a bracket 32 fast to the housing.

The connection 20 of the pneumatic cylinder 13 controlling the stitch length limiting stop 9 is connected by a flexible tube line 33 via a coupling piece 34 to a tube line 35 which connects connection 29 of the pneumatic cylinder 27 with the solenoid valve 31. Connection 28 of pneumatic cylinder 27 is connected via a tube line 36 to the solenoid valve 31. A compressed air source 37 is connectible through valve 31 to a selected end of the cylinder 27 and the cylinder 13.

The mode of operation is as follows:

The photoelectric work edge scanning device 30 is laid out so that in the darkened state, that is, when the work is inserted under the presser foot and the needle and interrupts the light beam of the scanning device, it trips the solenoid valve 31 and then assumes the switching position a. The pneumatic cylinder 27 is then pressurized with compressed air via line 35 and connection 29, while the other cylinder side is vented via connection 28, line 36 and return R. Consequently, the plunger 25 is lifted. Via the coupling piece 34, line 33 and connection 20, the piston of the pneumatic cylinder 13 is pressurized with compressed air. Thereby the piston rod 12, which together with the damping piece 11 forms the first stitch length limiting stop 9 for the stitch length setting lever 8, is pushed upward counter to the action of the compression spring 16 until the end face of its shank portion 15 abuts against the cap nut 17. The stitch length setting lever 8 is here set to the stitch length of a normal straight seam. The sewing machine may be switched on for binding the work edge applying against the guide rule 24. As soon as the work edge leaves the scanning point of the edge scanning device 30, e.g. for convex course of the work edge, the edge scanning device is illuminated by the now no longer interrupted light beam. Thereby, the solenoid valve 31 is actuated and moved to switching position b. In this switching position, the pneumatic cylinder 27 is pressurized via line 36 and connection 28 and vented via connection 29, line 25 and return R. The piston rod of pneumatic cylinder 27 provided with the plunger 25 is lowered in this switching position and thus plunger 25 is pressed against the work so that the work is braked and, since the cloth feed dog 17 continues to operate, forms a pivot for the convex edge area. Simultaneously with the pressurization of the pneumatic cylinder 27 via connection 28, the pneumatic cylinder 13 is vented via the lines 33, 35 and the return R, so that piston rod 12 with piston 14 and shank portion 15 is pushed down by the compression spring 16, stop 9 releasing the stitch length setting lever 8 under spring action, which thereupon is brought to apply against the setting screw 10 determining the second feed value position of cloth feed dog 17. Owing to this, the cloth feed dog 7 executes a greater feed movement as long as plunger 25 is lowered onto the work. This is done for the purpose of avoiding a stitch accumulation in the convex work edge area, which would occur if the same feed value as for sewing a straight seam were maintained. Due to the braking of the work by plunger 25, the straight feed movement of the cloth feed dog 7 brings about a rotation of the work, whereby the needle punctures are necessarily closer together than at straight feed. By increasing the feed movement of cloth feed dog 7, this stitch length shortening in the convex edge area is corrected and brought to the same stitch length as in the straight seam.

When the light beam is interrupted by the work at the end of the convex edge area, solenoid valve 31 trips and returns to the switching position a. Thereby, the pneumatic cylinder 27 is vented via connection 28, line 36 and return R and pressured with compressed air via the pump connection P, line 35 and connection 29, so that plunger 25 is raised. At the same time, via line 33 and connection 20, the pneumatic cylinder 13 is pressurized, whereby the stitch length setting lever 8 is moved by piston rod 12 with the damping piece 11 into the first feed value position (FIG. 1) for the normal stitch length, so that the further seam length is again sewn with normal stitch length.

At the end of the seam, the sewing machine is stopped with the needle in a high position and the work is removed after raising of the presser foot 5, whereupon the next workpiece can be inserted and the described cycle start anew.

While a specific embodiment of the invention has been shown and described in detail to illustrate the application of the principles of the invention, it will be understood that the invention may be embodied otherwise without departing from such principles.

What is claimed is:

1. A device for the automatic guiding of a workpiece on a sewing machine so as to produce a curved edge parallel seam and in a sewing machine which includes a reciprocating needle and a presser foot which are engageable with the workpiece and a feed member which is engageable with the workpiece as it moves through a substantially rectangular feed path to move it relative to the needle and, including a guide rule disposed in spaced relationship to the needle for guiding the edge of the workpiece and a scanner scanning the workpiece edge for sensing its position, the improvement comprising a plunger mounted above the workpiece and being movable into and out of engagement with the workpiece to hold the workpiece upon engagement therewith so as to permit the turning thereof during the feeding movement of said feed member, first drive means connected to said plunger to move said plunger toward and away from engagement with the workpiece, a stitch length setting mechanism connected to said feed member including a stitch length setting lever which is movable to change the length of feeding movement of said feeding member, a second drive mechanism including a rod movable through a path to engage said stitch length setting lever and displace it to adjust a feeding length of said feed member, said first drive means being connected to said second drive means so as to operate said second drive means as a function of said first drive means.

2. A device according to claim 1, wherein said first and second drive means are fluid pressure operated, the piston rod of said second fluid pressure operated drive means is engageable with said setting lever and movable to position it in a first end position of said lever, said lever being movable in an opposite direction and including a stop member disposed in the path of movement of said lever in said opposite direction limiting the movement thereof to a second end position of said setting lever.

3. A device according to claim 2, wherein said piston rod comprises a first limiting stop for said stitch length setting lever and including an adjustable stop member disposed in the path of said stitch length setting lever and defining a limit stop for said setting lever in an opposite direction of movement from the movement caused by said piston rod.

4. A device according to claim 2 or 3, including a control valve connected between said first fluid pressure operated drive means and said second fluid pressure operated drive means and a fluid pressure connection to said valve, said valve being shiftable to control the movement of said plunger and to control the movement of said piston.

* * * * *